US007139703B2

(12) United States Patent
Acero et al.

(10) Patent No.: US 7,139,703 B2
(45) Date of Patent: Nov. 21, 2006

(54) METHOD OF ITERATIVE NOISE ESTIMATION IN A RECURSIVE FRAMEWORK

(75) Inventors: Alejandro Acero, Bellevue, WA (US); Li Deng, Redmond, WA (US); James G. Droppo, Duvall, WA (US)

(73) Assignee: Microsoft Corporation, Redmond, WA (US)

( * ) Notice: Subject to any disclaimer, the term of this patent is extended or adjusted under 35 U.S.C. 154(b) by 642 days.

(21) Appl. No.: 10/237,162

(22) Filed: Sep. 6, 2002

(65) Prior Publication Data

US 2003/0191641 A1 Oct. 9, 2003

Related U.S. Application Data

(63) Continuation-in-part of application No. 10/116,792, filed on Apr. 5, 2002, now Pat. No. 6,944,590.

(51) Int. Cl.
*G10L 21/00* (2006.01)
*G10L 21/02* (2006.01)

(52) U.S. Cl. ..... 704/228; 704/226

(58) Field of Classification Search ..... None
See application file for complete search history.

(56) References Cited

U.S. PATENT DOCUMENTS

| | | | | |
|---|---|---|---|---|
| 4,918,735 | A | 4/1990 | Morito et al. | |
| 5,012,519 | A | 4/1991 | Adlersberg et al. | 381/47 |
| 5,148,489 | A | 9/1992 | Erell et al. | 704/226 |
| 5,604,839 | A | 2/1997 | Acero et al. | 395/2.43 |
| 5,727,124 | A * | 3/1998 | Lee et al. | 704/233 |
| 5,924,065 | A | 7/1999 | Eberman et al. | 704/231 |
| 6,092,045 | A | 7/2000 | Stubley et al. | 704/254 |
| 6,343,267 | B1 * | 1/2002 | Kuhn et al. | 704/222 |
| 6,778,954 | B1 | 8/2004 | Kim | |
| 6,944,590 | B1 * | 9/2005 | Deng et al. | 704/228 |
| 2003/0055640 | A1 * | 3/2003 | Burshtein et al. | 704/235 |
| 2003/0191637 | A1 | 10/2003 | Deng | |
| 2003/0216911 | A1 * | 11/2003 | Deng et al. | 704/227 |
| 2004/0064314 | A1 | 4/2004 | Aubert et al. | |

OTHER PUBLICATIONS

Gauvain et al. "Maximum a Posteriori Estimation for Multivariate Gaussian Mixture Observations of Markov Chains," Apr. 1994, IEEE Transactions on Speech and Audio Processing, vol. 2, No. 2, pp. 291-298.*

Y. Ephraim et al, "On second-order statistics and linear estimation of cepstral coefficients," IEEE Trans. Speech and Audio Proc., vol. 7, No. 2, pp. 162-176, Mar. 1999.

(Continued)

*Primary Examiner*—Talivaldis Ivars Smits
*Assistant Examiner*—Eunice Ng
(74) *Attorney, Agent, or Firm*—Steven M. Koehler; Westman, Champlin & Kelly, P.A.

(57) ABSTRACT

A method and apparatus estimate additive noise in a noisy signal using an iterative technique within a recursive framework. In particular, the noisy signal is divided into frames and the noise in each frame is determined based on the noise in another frame and the noise determined in a previous iteration for the current frame. In one particular embodiment, the noise found in a previous iteration for a frame is used to define an expansion point for a Taylor series approximation that is used to estimate the noise in the current frame. In one embodiment, noise estimation employs a recursive-Expectation-Maximization framework with a maximum likelihood (ML) criteria. In a further embodiment, noise estimation employs a recursive-Expectation-Maximization framework based on a MAP (maximum a posterior) criteria.

27 Claims, 6 Drawing Sheets

OTHER PUBLICATIONS

F.H.Liu, et al., "Environment normalization for robust speech recognition using direct cepstral comparison," in Proc.1994 IEEE ICASSP, Apr. 1994.
A.Acero et al., "Environmental robustness in automatic speech recognition," in Proc. 1990 ICASSP, Apr. 1990, vol. 2, pp. 849-552.
A.Acero et al., "Robust speech recognition by normalization of the acoustic space," in Proc. 1991 IEEE ICASSP, Apr. 1991, vol. 2, pp. 893-896.
P. Green et al, "Robust ASR based on clean speech models: An evaluation of missing data techniques for connected digit recognition in noise," in Proc. Eurospeech 2001, Aalborg, Denmark, Sep. 2001, pp. 213-216.
Communication dated Nov. 10, 2003 with European Search Report for EP 03020196.6.
Li Deng et al: "Recursive noise estimation using iterative stochastic approximation for stereo-based robust speech recognition" 2001 IEEE Workshop On Automatic Speech Recognition And Understanding. ASRU 2001. Conference Proceedings, Proceedings of IEEE Workshop on Automatic Speech Recognition and Understanding, Madonna Di Campiglio, Italy, Dec. 9-13, 2001, pp. 81-84.
Moreno P.J. et al, "A vector Taylor series 1-19 approach for environment-independent speech recognition", 1996 IEEE International Conference On Acoustics, Speech, and Signal Processing Conference Proceedings, 1996 IEEE International Conference On Acoustics, Speech, and Signal Processing Conference Proceedings, Atlanta, GA, pp. 733-736, vol. 2, 1996, New York, NY.
U.S. Appl. No. 10/117,142, filed Apr. 5, 2002, James G. Droppo et al.
U.S. Appl. No. 09/688,764, filed Oct. 16, 2000, Li Deng et al.
U.S. Appl. No. 09/688,950, filed Oct. 16, 2000, Li Deng et al.
"HMM Adaptation Using Vector Taylor Series for Noisy Speech Recognition," Alex Acero, et al., Proc. ICSLP, vol. 3, 2000, pp. 869-872.
"Sequential Noise Estimation with Optimal Forgetting for Robust Speech Recognition," Mohomed Afify, et al., Proc. ICASSP, vol. 1, 2001, pp. 229-232.
"High-Performance Robust Speech Recognition Using Stereo Training Data," Li Deng, et al., Proc. ICASSP, vol. 1, 2001, pp. 301-304.
"ALGONQUIN: Iterating Laplace's Method to Remove Multiple Types of Acoustic Distortion for Robust Speech Recognition," Brendan J. Frey, et al., Proc. Eurospeech, Sep. 2001, Aalborg, Denmark.
"Nonstationary Environment Compensation Based on Sequential Estimation," Nam Soo Kim, IEEE Signal Processing Letters, vol. 5, 1998, pp. 57-60.
"On-line Estimation of Hidden Markov Model Parameters Based on the Kullback-Leibler Information Measure," Vikram Krishnamurthy, et al., IEEE Trans. Sig. Proc., vol. 41, 1993, pp. 2557-2573.
"A Vector Taylor Series Approach for Environment-Independent Speech Recognition," Pedro J. Moreno, ICASSP, vol. 1, 1996, pp. 733-736.
"Recursive Parameter Estimation Using Incomplete Data," D.M. Titterington, J. J. Royal Stat. Soc., vol. 46(B), 1984, pp. 257-267.
"The Aurora Experimental Framework for the Performance Evaluations of Speech Recognition Systems Under Noisy Conditions," David Pearce, et al., Proc. ISCA IIRW ASR 2000, Sep. 2000.
"Efficient On-Line Acoustic Environment Estimation for FCDCN in a Continuous Speech Recognition System," Jasha Droppo, et al., ICASSP, 2001.
"Robust Automatic Speech Recognition With Missing and Unreliable Acoustic Data," Martin Cooke, Speech Communication, vol. 34, No. 3, pp. 267-285, Jun. 2001.
"Learning Dynamic Noise Models From Noisy Speech for Robust Speech Recognition," Brendan J. Frey, et al., Neural Information Processing Systems Conference, 2001, pp. 1165-1121.
"Speech Denoising and Dereverberation Using Probabilistic Models," Hagai Attias, et al., Advances in NIPS, vol. 13, 2000 pp. 758-764.
"Statistical-Model-Based Speech Enhancement System," Proc. of IEEE, vol. 80, No. 10, Oct. 1992, pp. 1526.
"HMM-Based Strategies for Enhancement of Speech Signals Embedded in Nonstationary Noise," Hossein Sameti, IEEE Trans. Speech Audio Processing, vol. 6, No. 5, Sep. 1998, pp. 445-455.
"Model-based Compensation of the Additive Noise for Continuous Speech Recognition," J.C. Segura, et al., Eurospeech 2001.
"Large-Vocabulary Speech Recognition Under Adverse Acoustic Environments," Li Deng, et al., Proc. ICSLP, vol. 3, 2000, pp. 806-809.
"A Compact Model for Speaker-Adaptive Training," Anastasakos, T., et al., BBN Systems and Technologies, pp. 1137-1140, undated.
"Suppression of Acoustic Noise in Speech Using Spectral Subtraction," Boll, S. F., IEEE Transactions on Acoustics, Speech and Signal Processing, vol. ASSP-27, No. 2, pp. 113-120 (Apr. 1979).
"Experiments With a Nonlinear Spectral Subtractor (NSS), Hidden Markov Models and the Projection, for Robust Speech Recognition in Cars," Lockwood, P. et al., Speech Communication 11, pp. 215-228 (1992).
"A Spectral Subtraction Algorithm for Suppression of Acoustic Noise in Speech," Boll, S.F., IEEE International Conference on Acoustics, Speech & Signal Processing, pp. 200-203 (Apr. 2-4, 1979).
"Enhancement of Speech Corrupted by Acoustic Noise," Berouti, M. et al., IEEE International Conference on Acoustics, Speech & Signal Processing, pp. 208-211 (Apr. 2-4, 1979).
"Acoustical and Environmental Robustness in Automatic Speech Recognition," Acero, A., Department of Electrical and Computer Engineering, Carnegie Mellon University, pp. 1-141 (Sep. 13, 1990).
"Speech Recognition in Noisy Environments," Pedro J. Moreno, Ph.D thesis, Carnegie Mellon University, 1996.
"A New Method for Speech Denoising and Robust Speech Recognition Using Probabilistic Models for Clean Speech and for Noise," Hagai Attias, et al., Proc. Eurospeech, 2001, pp. 1903-1906.
L. Deng, J. Droppo and A. Acero. *Recursive Noise Estimation Using Iterative Stochastic Approximation for Stereo-based Robust Speech Recognition*, in *Proc. of the IEEE Workshop on Automatic Speech Recognition and Understanding*. Madonna di Campiglio, Italy, Dec. 2001.
Huo et al., "On-line Adaptive Learning of the Continuous Density Hidden Markov Model Based on Approximate Recursive Bayes Estimate", Proc. IEEE, Speech and Audio Processing, vol. 5, No. 2, pp. 161-172, Mar. 2, 1997, XP000771954.
Acero et al., "Log-domain speech feature enhancement using sequential MAP noise estimation and a phase-sensitive model of the acoustic environment," Proc. ICSLP, Denver CO, Sep. 2002, pp. 1813-1816.
J. Spragins. "A note on the iterative application of Bayes' rule," IEEE Trans. Inform. Theory, vol. 11, No. 4, pp. 544-549.
L. Deng, J. Droppo, and A. Acero. "A Bayesian approach to speech feature enhancement using the dynamic cepstral prior," *Proc. ICASSP*, vol. I, Orlando, Florida, May 2002, pp. 829-832.
J. Droppo, L. Deng, and A. Acero. "Evaluation of the SPLICE algorithm on the Aurora2 database," *Proc. Eurospeech*, Sep. 2001, pp. 217-220.
J. Droppo, A. Acero, and L. Deng, "Uncertainty decoding with SPLICE for noise robust speech recognition," in *Proc. 2002 ICASSP*, Orlando, Florida, May 2002.
Kristjansson T. et al, "Towards non-stationary model-based noise adaptation for large vocabulary speech recognition" 2001 IEEE International Conference on Acoustics, Speech, and Signal Processing, May 7-11, 2001, pp. 337-340, vol. 1.
J. Droppo, A. Acero and L. Deng:"A nonlinear observation model for removing noise from corrupted speech log mel-spectral energies", Proceedings ICSLP 2002, pp. 1569-1572.
L. Deng, J. Droppo and A. Acero: "Log-domain speech feature enhancement using sequential map noise estimation and a phase-sensitive model of the acoustic environment", Proceedings ICSLP 2002, Sep. 16-20, 2002, pp. 1813-1816.
N.B. Yoma, F.R. McInnes, and M.A. Jack, "Improving performance of spectral substraction in speech recognition using a model for additive noise," IEEE Trans. On Speech and Audio Processing, vol. 6, No. 6, pp. 579-582, Nov. 1998.

Y.Zhao, "Frequency-domain maximum likelihood estimation for automatic speech recognition in additive and convolutive noises," IEEE Trans. Speech and Audio Proc., vol. 8, No. 3, pp. 255-266, May 2000.

H.Y. Jung et al., "On the temporal decorrelation of feature parameters for noise-robust speech recognition," in Proc. 2000 ICASSP, May 2000, vol. 8, pp. 407-416.

Li Deng and Jeff Ma, "Spontaneous speech recognition using a statistical coarticulatory model for the vocal-tract-resonance dynamics," J. Acoust. Soc. Am. 108 (5), Pt. 1, Nov. 2002.

Jeff Ma and Li Deng, "A path-stack algorithm for optimizing dynamic regimes in a statistical hidden dynamic model of speech," *Computer Speech and Language 2000*, 00, 1-14.

* cited by examiner

METHOD OF ITERATIVE NOISE ESTIMATION IN A RECURSIVE FRAMEWORK

CROSS REFERENCE TO RELATED APPLICATIONS

This application is a continuation-in-part of application Ser. No. 10/116,792, filed Apr. 5, 2002, now U.S. Pat. No. 6,644,590 the priority of which is hereby claimed.

BACKGROUND OF THE INVENTION

The present invention relates to noise estimation. In particular, the present invention relates to estimating noise in signals used in pattern recognition.

A pattern recognition system, such as a speech recognition system, takes an input signal and attempts to decode the signal to find a pattern represented by the signal. For example, in a speech recognition system, a speech signal (often referred to as a test signal) is received by the recognition system and is decoded to identify a string of words represented by the speech signal.

Input signals are typically corrupted by some form of noise. To improve the performance of the pattern recognition system, it is often desirable to estimate the noise in the noisy signal.

In the past, two general frameworks have been used to estimate the noise in a signal. In one framework, batch algorithms are used that estimate the noise in each frame of the input signal independent of the noise found in other frames in the signal. The individual noise estimates are then averaged together to form a consensus noise value for all of the frames. In the second framework, a recursive algorithm is used that estimates the noise in the current frame based on noise estimates for one or more previous or successive frames. Such recursive techniques allow for the noise to change slowly over time.

In one recursive technique, a noisy signal is assumed to be a non-linear function of a clean signal and a noise signal. To aid in computation, this non-linear function is often approximated by a truncated Taylor series expansion, which is calculated about some expansion point. In general, the Taylor series expansion provides its best estimates of the function at the expansion point. Thus, the Taylor series approximation is only as good as the selection of the expansion point. Under the prior art, however, the expansion point for the Taylor series was not optimized for each frame. As a result, the noise estimate produced by the recursive algorithms has been less than ideal.

In light of this, a noise estimation technique is needed that is more effective at estimating noise in pattern signals.

SUMMARY OF THE INVENTION

A method and apparatus estimate additive noise in a noisy signal using an iterative technique within a recursive framework. In particular, the noisy signal is divided into frames and the noise in each frame is determined based on the noise in another frame and the noise determined in a previous iteration for the current frame. In one particular embodiment, the noise found in a previous iteration for a frame is used to define an expansion point for a Taylor series approximation that is used to estimate the noise in the current frame.

In one embodiment, noise estimation employs a recursive-Expectation-Maximization framework with a maximum likelihood (ML) criteria. In a further embodiment, noise estimation employs a recursive-Expectation-Maximization framework based on a MAP (maximum a posterior) criteria. The noise estimate utilizing MAP criteria uses and improves upon the ML criteria by including prior information based on portions of a pattern signal that contains only noise, for example, portions preceding and/or following a portion with observation data. The prior information constrains the maximum likelihood auxiliary function by providing, in effect, a range in which the noise should fall within.

DETAILED DESCRIPTION OF ILLUSTRATIVE EMBODIMENTS

Figure 1:
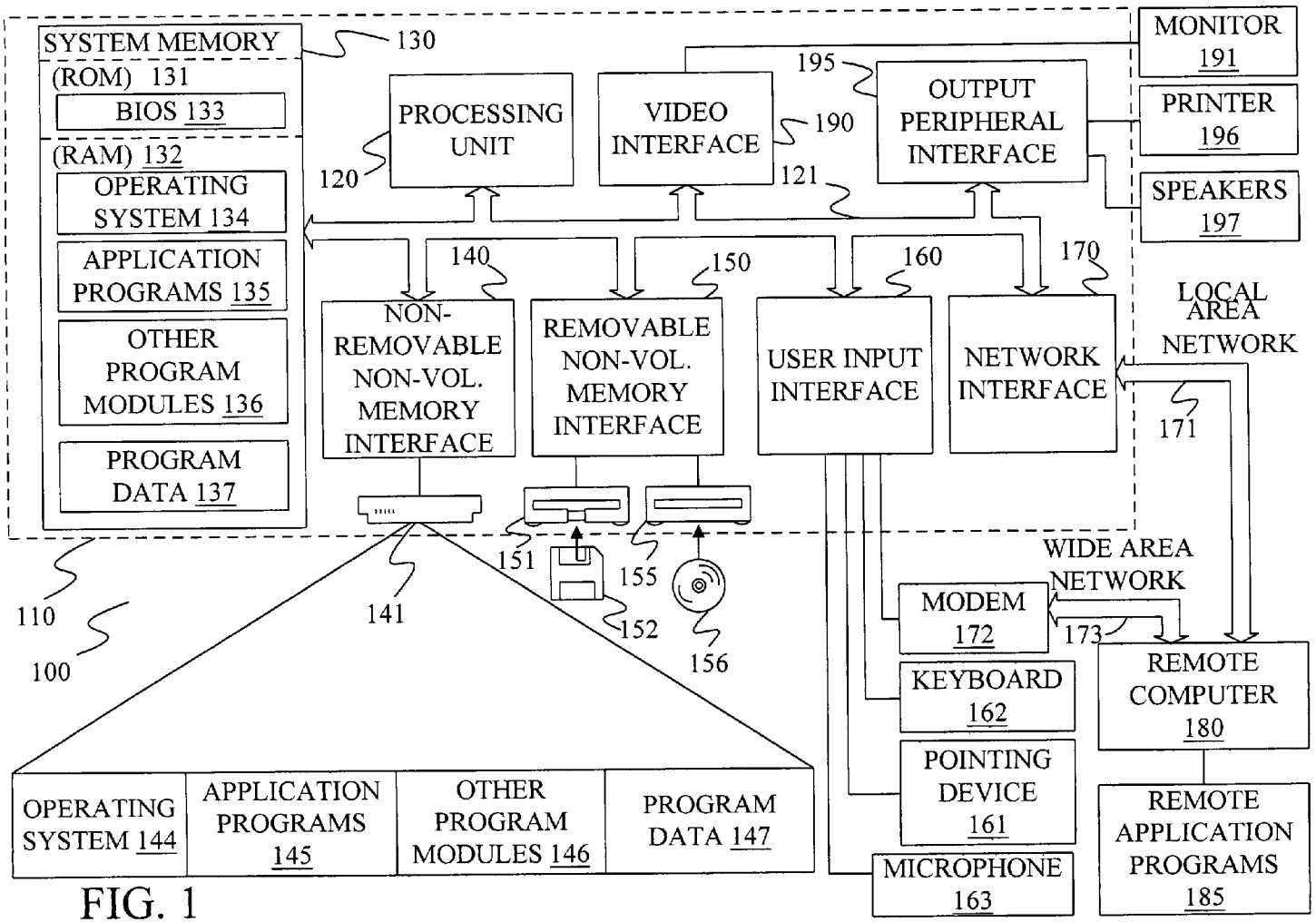
FIG. 1 is a block diagram of one computing environment in which the present invention may be practiced.

FIG. 1 illustrates an example of a suitable computing system environment 100 on which the invention may be implemented. The computing system environment 100 is only one, example of a suitable computing environment and is not intended to suggest any limitation as to the scope of use or functionality of the invention. Neither should the computing environment 100 be interpreted as having any dependency or requirement relating to any one or combination of components illustrated in the exemplary operating environment 100.

The invention is operational with numerous other general purpose or special purpose computing system environments or configurations. Examples of well-known computing systems, environments, and/or configurations that may be suitable for use with the invention include, but are not limited to, personal computers, server computers, hand-held or laptop devices, multiprocessor systems, microprocessor-based systems, set top boxes, programmable consumer electronics, network PCs, minicomputers, mainframe computers, telephony systems, distributed computing environments that include any of the above systems or devices, and the like.

The invention may be described in the general context of computer-executable instructions, such as program modules, being executed by a computer. Generally, program modules include routines, programs, objects, components, data structures, etc. that perform particular tasks or implement particular abstract data types. Tasks performed by the programs and modules are described below and with the aid of figures. Those skilled in the art can implement the description and figures as computer-executable instructions, which can be embodied on any form of computer readable media discussed below.

The invention may also be practiced in distributed computing environments where tasks are performed by remote processing devices that are linked through a communications network. In a distributed computing environment, program modules may be located in both local and remote computer storage media including memory storage devices.

With reference to FIG. 1, an exemplary system for implementing the invention includes a general-purpose computing device in the form of a computer 110. Components of computer 110 may include, but are not limited to, a processing unit 120, a system memory 130, and a system bus 121 that couples various system components including the system memory to the processing unit 120. The system bus 121 may be any of several types of bus structures including a memory bus or memory controller, a peripheral bus, and a local bus using any of a variety of bus architectures. By way of example, and not limitation, such architectures include Industry Standard Architecture (ISA) bus, Micro Channel Architecture (MCA) bus, Enhanced ISA (EISA) bus, Video Electronics Standards Association (VESA) local bus, and Peripheral Component Interconnect (PCI) bus also known as Mezzanine bus.

Computer 110 typically includes a variety of computer readable media. Computer readable media can be any available media that can be accessed by computer 110 and includes both volatile and nonvolatile media, removable and non-removable media. By way of example, and not limitation, computer readable media may comprise computer storage media and communication media. Computer storage media includes both volatile and nonvolatile, removable and non-removable media implemented in any method or technology for storage of information such as computer readable instructions, data structures, program modules or other data. Computer storage media includes, but is not limited to, RAM, ROM, EEPROM, flash memory or other memory technology, CD-ROM, digital versatile disks (DVD) or other optical disk storage, magnetic cassettes, magnetic tape, magnetic disk storage or other magnetic storage devices, or any other medium which can be used to store the desired information and which can be accessed by computer 110. Communication media typically embodies computer readable instructions, data structures, program modules or other data in a modulated data signal such as a carrier wave or other transport mechanism and includes any information delivery media. The term "modulated data signal" means a signal that has one or more of its characteristics set or changed in such a manner as to encode information in the signal. By way of example, and not limitation, communication media includes wired media such as a wired network or direct-wired connection, and wireless media such as acoustic, RF, infrared and other wireless media. Combinations of any of the above should also be included within the scope of computer readable media.

The system memory 130 includes computer storage media in the form of volatile and/or nonvolatile memory such as read only memory (ROM) 131 and random access memory (RAM) 132. A basic input/output system 133 (BIOS), containing the basic routines that help to transfer information between elements within computer 110, such as during start-up, is typically stored in ROM 131. RAM 132 typically contains data and/or program modules that are immediately accessible to and/or presently being operated on by processing unit 120. By way of example, and not limitation, FIG. 1 illustrates operating system 134, application programs 135, other program modules 136, and program data 137.

The computer 110 may also include other removable/non-removable volatile/nonvolatile computer storage media. By way of example only, FIG. 1 illustrates a hard disk drive 141 that reads from or writes to non-removable, nonvolatile magnetic media, a magnetic disk drive 151 that reads from or writes to a removable, nonvolatile magnetic disk 152, and an optical disk drive 155 that reads from or writes to a removable, nonvolatile optical disk 156 such as a CD ROM or other optical media. Other removable/non-removable, volatile/nonvolatile computer storage media that can be used in the exemplary operating environment include, but are not limited to, magnetic tape cassettes, flash memory cards, digital versatile disks, digital video tape, solid state RAM, solid state ROM, and the like. The hard disk drive 141 is typically connected to the system bus 121 through a non-removable memory interface such as interface 140, and magnetic disk drive 151 and optical disk drive 155 are typically connected to the system bus 121 by a removable memory interface, such as interface 150.

The drives and their associated computer storage media discussed above and illustrated in FIG. 1, provide storage of computer readable instructions, data structures, program modules and other data for the computer 110. In FIG. 1, for example, hard disk drive 141 is illustrated as storing operating system 144, application programs 145, other program modules 146, and program data 147. Note that these components can either be the same as or different from operating system 134, application programs 135, other program modules 136, and program data 137. Operating system 144, application programs 145, other program modules 146, and program data 147 are given different numbers here to illustrate that, at a minimum, they are different copies.

A user may enter commands and information into the computer 110 through input devices such as a keyboard 162, a microphone 163, and a pointing device 161, such as a mouse, trackball or touch pad. Other input devices (not shown) may include a joystick, game pad, satellite dish, scanner, or the like. These and other input devices are often connected to the processing unit 120 through a user input interface 160 that is coupled to the system bus, but may be connected by other interface and bus structures, such as a parallel port, game port or a universal serial bus (USB). A monitor 191 or other type of display device is also connected to the system bus 121 via an interface, such as a video interface 190. In addition to the monitor, computers may also include other peripheral output devices such as speakers 197 and printer 196, which may be connected through an output peripheral interface 190.

The computer 110 may operate in a networked environment using logical connections to one or more remote computers, such as a remote computer 180. The remote computer 180 may be a personal computer, a hand-held device, a server, a router, a network PC, a peer device or other common network node, and typically includes many or all of the elements described above relative to the computer 110. The logical connections depicted in FIG. 1 include a local area network (LAN) 171 and a wide area network (WAN) 173, but may also include other networks. Such networking environments are commonplace in offices, enterprise-wide computer networks, intranets and the Internet.

When used in a LAN networking environment, the computer 110 is connected to the LAN 171 through a network interface or adapter 170. When used in a WAN networking environment, the computer 110 typically includes a modem 172 or other means for establishing communications over the WAN 173, such as the Internet. The modem 172, which may be internal or external, may be connected to the system bus 121 via the user input interface 160, or other appropriate mechanism. In a networked environment, program modules depicted relative to the computer 110, or portions thereof, may be stored in the remote memory storage device. By way of example, and not limitation, FIG. 1 illustrates remote application programs 185 as residing on remote computer 180. It will be appreciated that the network connections shown are exemplary and other means of establishing a communications link between the computers may be used.

Figure 2:
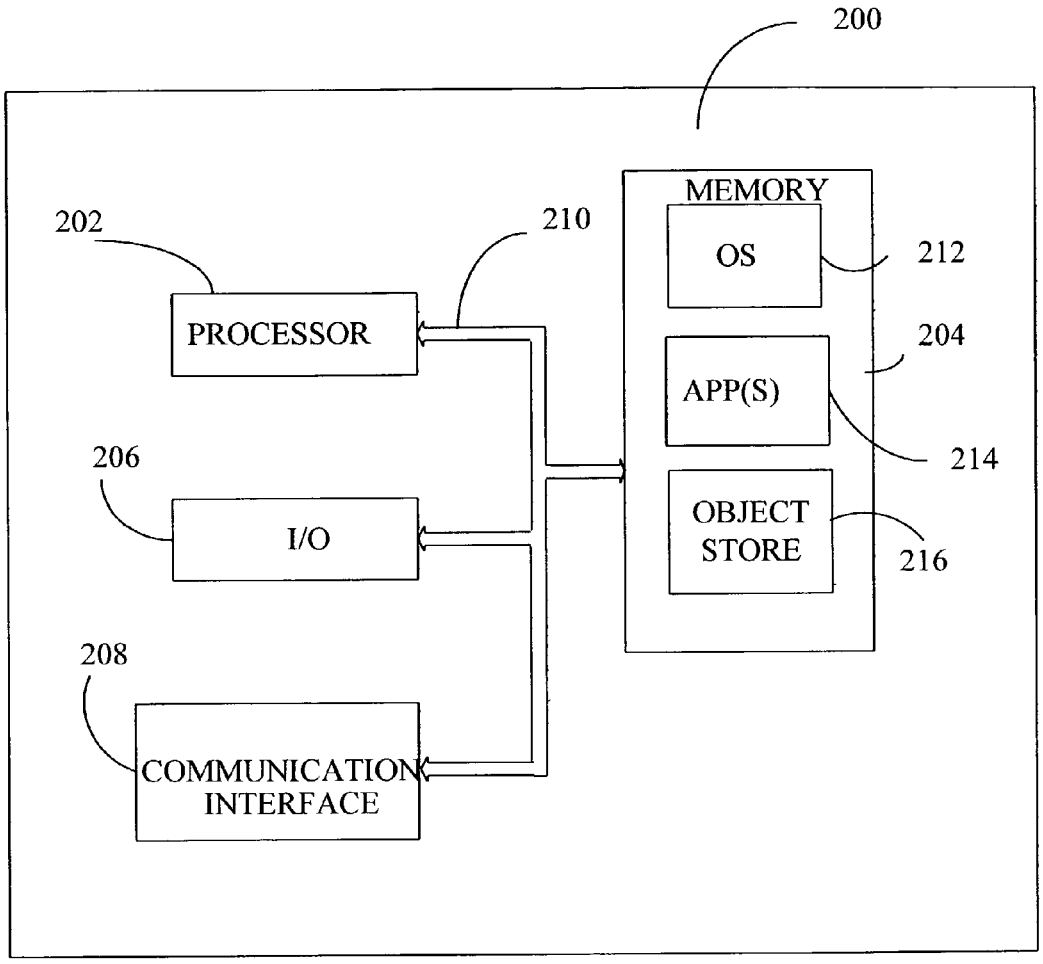
FIG. 2 is a block diagram of an alternative computing environment in which the present invention may be practiced.

FIG. 2 is a block diagram of a mobile device 200, which is an exemplary computing environment. Mobile device 200 includes a microprocessor 202, memory 204, input/output (I/O) components 206, and a communication interface 208 for communicating with remote computers or other mobile devices. In one embodiment, the afore-mentioned components are coupled for communication with one another over a suitable bus 210.

Memory 204 is implemented as non-volatile electronic memory such as random access memory (RAM) with a battery back-up module (not shown) such that information stored in memory 204 is not lost when the general power to mobile device 200 is shut down. A portion of memory 204 is preferably allocated as addressable memory for program execution, while another portion of memory 204 is preferably used for storage, such as to simulate storage on a disk drive.

Memory 204 includes an operating system 212, application programs 214 as well as an object store 216. During operation, operating system 212 is preferably executed by processor 202 from memory 204. Operating system 212, in one preferred embodiment, is a WINDOWS® CE brand operating system commercially available from Microsoft Corporation. Operating system 212 is preferably designed for mobile devices, and implements database features that can be utilized by applications 214 through a set of exposed application programming interfaces and methods. The objects in object store 216 are maintained by applications 214 and operating system 212, at least partially in response to calls to the exposed application programming interfaces and methods.

Communication interface 208 represents numerous devices and technologies that allow mobile device 200 to send and receive information. The devices include wired and wireless modems, satellite receivers and broadcast tuners to name a few. Mobile device 200 can also be directly connected to a computer to exchange data therewith. In such cases, communication interface 208 can be an infrared transceiver or a serial or parallel communication connection, all of which are capable of transmitting streaming information.

Input/output components 206 include a variety of input devices such as a touch-sensitive screen, buttons, rollers, and a microphone as well as a variety of output devices including an audio generator, a vibrating device, and a display. The devices listed above are by way of example and need not all be present on mobile device 200. In addition, other input/output devices may be attached to or found with mobile device 200 within the scope of the present invention.

Under one aspect of the present invention, a system and method are provided that estimate noise in pattern recognition signals. To do this, the present invention uses a recursive algorithm to estimate the noise at each frame of a noisy signal based in part on a noise estimate found for at least one neighboring frame. Under the present invention, the noise estimate for a single frame is iteratively determined with the noise estimate determined in the last iteration being used in the calculation of the noise estimate for the next iteration. Through this iterative process, the noise estimate improves with each iteration resulting in a better noise estimate for each frame.

In one embodiment, the noise estimate is calculated using a recursive formula that is based on a non-linear relationship between noise, a clean signal and a noisy signal of:

$$y \approx x + C\ln(I + \exp[C^T(n - x)]) \quad \text{EQ. 1}$$

where y is a vector in the cepstra domain representing a frame of a noisy signal, x is a vector representing a frame of a clean signal in the same cepstral domain, n is a vector representing noise in a frame of a noisy signal also in the same cepstral domain, C is a discrete cosine transform matrix, and I is the identity matrix.

To simplify the notation, a vector function is defined as:

$$g(z) = C\ln(I + \exp[C^T z]) \quad \text{EQ. 2}$$

To improve tractability when using Equation 1, the non-linear portion of Equation 1 is approximated using a Taylor series expansion truncated up to the linear terms, with an expansion point $\mu_0^x - n_0$. This results in:

$$y = x + g(n_0 - \mu_0^x) + G(n_0 - \mu_0^x)(x - \mu_0^x) + [I - G(n_0 - \mu_0^x)](n - n_0) \quad \text{EQ. 3}$$

where G is the gradient of g(z) and is computed as:

$$G(z) = C\,diag\left(\frac{1}{1 + \exp[C^T z]}\right)C^T \quad \text{EQ. 4}$$

The recursive formula used to select the noise estimate for a frame of a noisy signal is then determined as the solution to a recursive-Expectation-Maximization optimization problem. This results in a recursive noise estimation equation of:

$$n_{t+1} = n_t + K_{t+1}^{-1} s_{t+1} \quad \text{EQ. 5}$$

where $n_t$, is a noise estimate of a past frame, $n_{t+1}$ is a noise estimate of a current frame and $s_{t+1}$ and $K_{t+1}$ are defined as:

$$s_{t+1} = \sum_{m=1}^{M} \gamma_{t+1}(m)[I - G(n_0 - \mu_0^x)]^T \left(\sum_m^y\right)^{-1} [y_{t+1} - \mu_m^y(n_{t+1})] \quad \text{EQ. 6}$$

$$K_{t+1} = \epsilon \cdot K_t - L_{t+1} \quad \text{EQ. 7}$$

where $$L_{t+1} = \sum_{m=1}^{M} \gamma_{t+1}(m)[I - G(n_0 - \mu_0^x)]^T \left(\sum_m^y\right)^{-1} [I - G(n_0 - \mu_0^x)] \quad \text{EQ. 8}$$

$$\gamma_{t+1}(m) = p(m|y_{t+1}, n_t) \quad \text{EQ. 9}$$

and where $\epsilon$ is a forgetting factor that controls the degree to which the noise estimate of the current frame is based on a past frame, $\mu_m^y$ is the mean of a distribution of noisy feature vectors, y, for a mixture component m and $\Sigma_m^y$ is a covariance matrix for the noisy feature vectors y of mixture component m. Using the relationship of Equation 3, $\mu_m^y$ and $\Sigma_m^y$ can be shown to relate to other variables according to:

$$\mu_m^y = \mu_m^x + g(n_0 - \mu_0^x) + G(n_0 - \mu_0^x)(\mu_m^x - \mu_0^x) + [I - G(n_0 - \mu_0^x)](n - n_0) \quad \text{EQ. 10}$$

$$\Sigma_m^y = [I + G(n_0 - \mu_0^x)]\Sigma_m^x[I + G^T(n_0 - \mu_0^x)]^T \quad \text{EQ. 11}$$

where $\mu_m^x$ is the mean of a Gaussian distribution of clean feature vectors x for mixture component m and $\Sigma_m^x$ is a covariance matrix for the distribution of clean feature vectors x of mixture component m. Under one embodiment, $\mu_m^x$ and $\Sigma_m^x$ for each mixture component m are determined from a set of clean input training feature vectors that are grouped into mixture components using one of any number of known techniques such as a maximum likelihood training technique.

Figure 3:
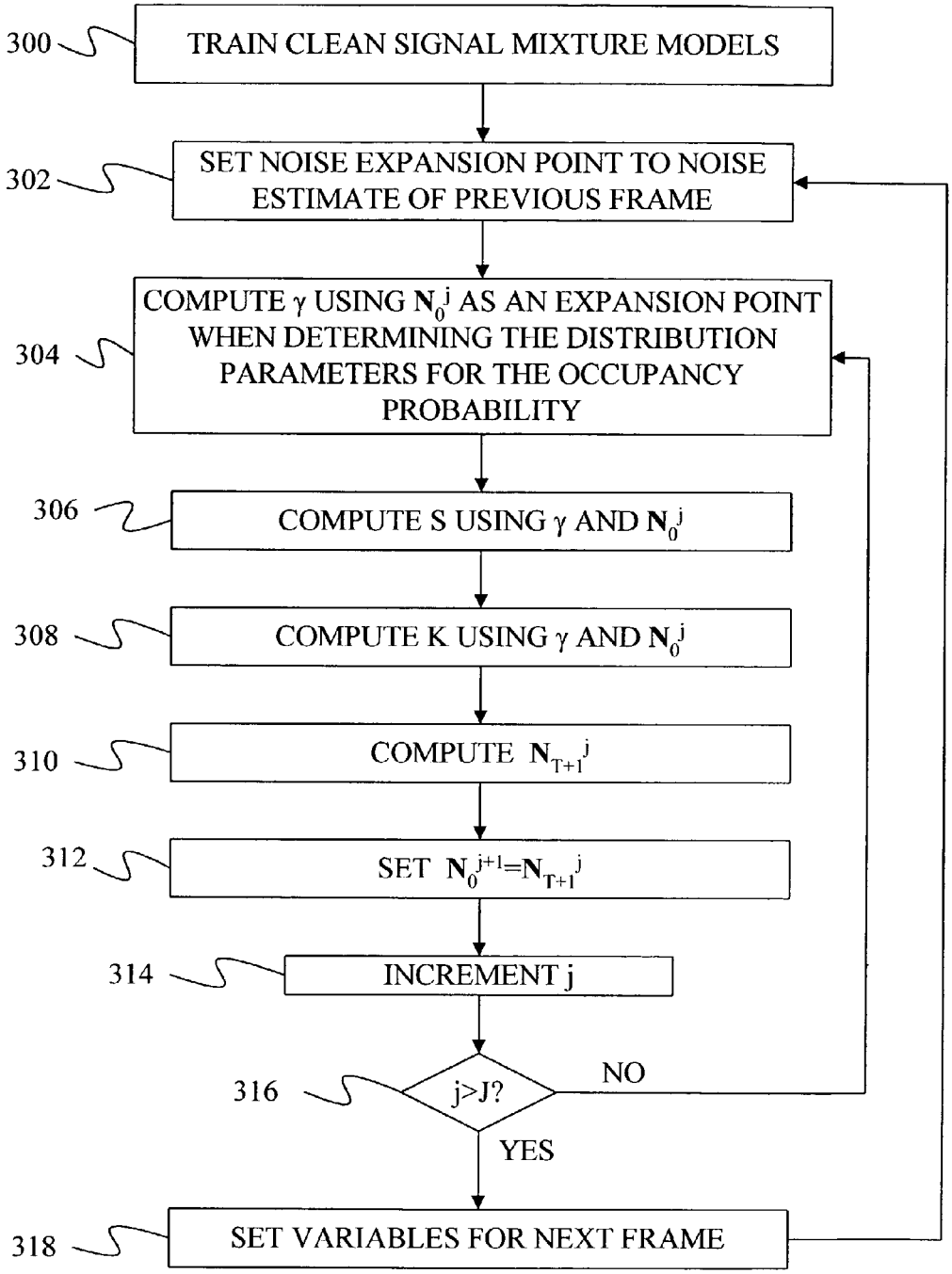
FIG. 3 is a flow diagram of a method of estimating noise under one embodiment of the present invention.

Under the present invention, the noise estimate of the current frame, $n_{t+1}$, is calculated several times using an iterative method shown in the flow diagram of FIG. 3.

The method of FIG. 3 begins at step 300 where the distribution parameters for the clean signal mixture model are determined from a set of clean training data. In particular, the mean, $\mu_m^x$, covariance, $\Sigma_m^x$, and mixture weight, $c_m$, for each mixture component m in a set of M mixture components is determined.

At step 302, the expansion point, $n_0^j$, used in the Taylor series approximation for the current iteration, j, is set equal to the noise estimate found for the previous frame. In terms of an equation:

$$n_0^j = n_t \quad \text{EQ. 12}$$

Equation 12 is based on the assumption that the noise does not change much between frames. Thus, a good beginning estimate for the noise of the current frame is the noise found in the previous frame.

At step 304, the expansion point for the current iteration is used to calculate $\gamma_{t+1}^j$. In particular, $\gamma_{t+1}^j(m)$ is calculated as:

$$\gamma_{t+1}^j(m) = \frac{p(y_{t+1}|m, n_t)c_m}{\sum_{m=1}^{M} p(y_{t+1}|m, n_t)c_m} \quad \text{EQ. 13}$$

where $p(y_{t+1}|m,n_t)$ is determined as:

$$p(y_{t+1}|m,n_t) = N[y_{t+1}; \mu_m^y(n), \Sigma_m^y] \quad \text{EQ. 14}$$

with $$\mu_m^y = \mu_m^x + g(n_0^j - \mu_0^x) + G(n_0^j - \mu_0^x)(\mu_m^x - \mu_0^x) + [I - G(n_0^j - \mu_0^x)](n_t - n_0) \quad \text{EQ. 15}$$

$$\Sigma_m^y = [I + G(n_0^j - \mu_0^x)]\Sigma_m^x[I + G^T(n_0^j - \mu_0^x)]^T \quad \text{EQ. 16}$$

After $\gamma_{t+1}^j(m)$ has been calculated, $s_{t+1}^j$ is calculated at step 306 using:

$$s_{t+1} = \quad \text{EQ. 17}$$

-continued $$\sum_{m=1}^{M} \gamma_{t+1}(m)[I - G(n_0^j - \mu_m^x)]^T \left(\sum_m^y\right)^{-1} [y_{t+1} - \mu_m^x - g(n_0^j - \mu_m^x)]$$

and $K_{t+1}^j$ is calculated at step 308 using:

$$K_{t+1}^j = \quad \text{EQ. 18}$$

$$\varepsilon K_t^j - \sum_{m=1}^{M} \gamma_{t+1}(m)[I - G(n_0^j - \mu_0^x)]^T \left(\sum_m^y\right)^{-1} [I - G(n_0^j - \mu_0^x)]$$

Once $s_{t+1}^j$ and $K_{t+1}^j$ have been determined, the noise estimate for the current frame and iteration is determined at step 310 as:

$$n_{t+1}^j = n_t + \alpha \cdot [K_{t+1}^j]^{-1} s_{t+1}^j \quad \text{EQ. 19}$$

where $\alpha$ is an adjustable parameter that controls the update rate for the noise estimate. In one embodiment $\alpha$ is set to be inversely proportional to a crude estimate of the noise variance for each separate test utterance.

At step 312, the Taylor series expansion point for the next iteration, $n_0^{j+1}$, is set equal to the noise estimate found for the current iteration, $n_{t+1}^j$. In terms of an equation:

$$n_0^{j+1} = n_{t+1}^j \quad \text{EQ. 20}$$

The updating step shown in equation 20 improves the estimate provided by the Taylor series expansion and thus improves the calculation of $\gamma_{t+1}^j(m)$, $s_{t+1}^j$ and $K_{t+1}^j$ during the next iteration.

At step 314, the iteration counter j is incremented before being compared to a set number of iterations J at step 316. If the iteration counter is less than the set number of iterations, more iterations are to be performed and the process returns to step 304 to repeat steps 304, 306, 308, 310, 312, 314, and 316 using the newly updated expansion point.

After J iterations have been performed at step 316, the final value for the noise estimate of the current frame has been determined and at step 318, the variables for the next frame are set. Specifically, the iteration counter j is set to zero, the frame value t is incremented by one, and the expansion point $n_0$ for the first iteration of the next frame is set to equal to the noise estimate of the current frame.

The foregoing noise estimation technique provides a recursive-Expectation-Maximization optimization using a maximum likelihood criteria. In a further embodiment, noise estimation can be based on a MAP (maximum a posterior) criteria. In the embodiment illustrated, this algorithm is based on the maximum likelihood (ML) criteria as discussed above within the recursive-Expectation-Maximization framework.

The recursive-Expectation-Maximization framework includes an Expectation step and a Maximization step. In the Expectation step, the objective function with MAP criteria, or the MAP auxiliary function is given by $$Q_{MAP}(n_t)=Q_{ML}(n_t)+\rho \log p(n_t), \quad \text{EQ. 21}$$

where $Q_{ML}(n_t)$ is the maximum likelihood auxiliary function described above, and where $p(n_t)$ is the fixed prior distribution of Gaussian for noise $n_t$, and where $\rho$ is a variance scaling factor.

In equation 21, the quantity $\rho \log p(n_t)$ can be referred to as "prior information". From the terms contained therein, the prior information does not contain any data, i.e., observations $y_t$, but rather, as based only on noise. In contrast, the auxiliary function $Q_{ML}(n_t)$ is based both on observations $y_t$ and noise $n_t$. The prior information constrains $Q_{ML}(n_t)$ by providing, in effect, a range in which the noise should fall within. The variance scaling factor $\rho$ weights the prior information relative to the ML auxiliary function $Q_{ML}(n_t)$.

Figure 4:
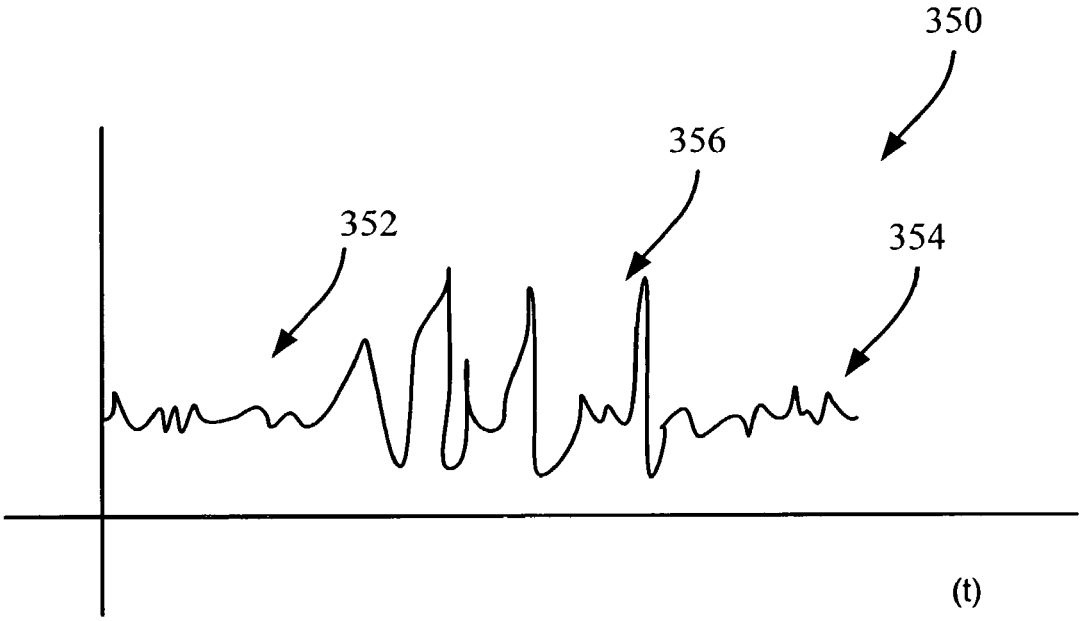
FIG. 4 is a pictorial representation of an utterance.

The prior information, and in particular, $p(n_t)$ is obtained from non-speech portions of an utterance. Referring to FIG. 4, a given pattern signal 350, herein by example an utterance, may have a preceding portion 352 and a following portion 354 that have no speech contained therein, and therefore, comprise only noise. In FIG. 4, portion 356 represents speech data. The prior information can be based on one or both of the portions 352 and 354. The prior information is made Gaussian by taking the mean and the variance. For example, in one embodiment, the portions used to compute the prior information can be identified by a level detector, which identifies corresponding portions as speech data if a level or energy content is exceeded, while those portions that do not exceed the selected level or energy content can be identified and used to calculate the prior information. However, it should be noted that calculation of the prior information is not limited to those portions immediately adjacent the speech portion 356 for a given utterance 350.

Referring back to equation 20, the maximum likelihood (ML) auxiliary function $Q_{ML}(n_t)$ can be expressed as the following conditional expectation:

$$\begin{aligned} Q_{ML}(n_t) &= E[\log p(y_1^t, M_1^t|n_t)|y_1^t, n_1^{t-1}] \\ &= \sum_{\tau=1}^{t}\sum_{m=1}^{M} \xi_\tau(m)\log p(y_\tau|m, n_t), \end{aligned} \quad \text{EQ. 22}$$

which, after introducing the forgetting factor $\epsilon$, becomes $$\begin{aligned} Q_{ML(n_t)} &\approx \sum_{\tau=1}^{t}\epsilon^{t-\tau}\sum_{m=1}^{M}\xi_\tau(m)\log p(y_\tau \mid m, n_t) \\ &= -\sum_{\tau=1}^{t}\epsilon^{t-\tau}\sum_{m=1}^{M}\xi_\tau(m)\frac{(y_\tau-\mu_m^y)^2}{2\,\Sigma_m^y} + Const. \end{aligned} \quad \text{EQ. 23}$$

The forgetting factor $\epsilon$ controls the balance between the ability of the algorithm to track noise non-stationary and the reliability of the noise estimate, $M_1^t$ is the sequence of the speech model's mixture components up to frame t, and $\xi_t(m)=p(m|y_T,n_{T-1})$ is the posterior probability.

It should be noted that the exponential decay of the forgetting factor $\epsilon$ herein illustrated is but one distribution for forgetting (i.e. weighting) factors that can be used. The example provided herein should not be considered limiting, because as appreciated by those skilled in the art, other distributions for forgetting factors can be used.

The posterior probability is computer using Bayes rule $$\xi_\tau(m) = \frac{c_m p(y_\tau \mid m, n_{\tau-1})}{\Sigma_m c_m p(y_\tau \mid m, n_{\tau-1})}, \quad \text{EQ. 24}$$

where likelihood $p(m|y_T,n_{T-1})$ is approximated by a Gaussian with the mean and variance of $$\begin{aligned} &\mu_m^y \approx \mu_m^x + g_m + [1-G_m](n_t-n_0) \\ &\Sigma_m^y \approx (1+G_m)^2\Sigma_m^x + (1-G_m)^2\Sigma^n. \end{aligned} \quad \text{EQ. 25}$$

In the above equation, $g_m$ and $G_m$ are computable quantities introduced to linearly approximate the relationship among noisy speech y, clean speech x, and noise n (all in the form of log spectra). $\Sigma_n$ is the fixed variance (hyper-parameter) of the prior noise PDF $p(n_t)$, which is assumed to be Gaussian (with the fixed hyper-parameter mean of $\mu_n$). Finally, $n_o$ is the Taylor series expansion point for the noise, which is iteratively updated by the MAP estimate in the Maximization-step described below.

In the Maximization step, an estimate is obtained for $n_t$ by setting $$\frac{\partial Q_{MAP}(n_t)}{\partial n_t} = 0. \quad \text{EQ. 26}$$

Noting from equation 25 that $\mu_m^y$ is a linear function of $n_t$, the following equation is obtained:

$$\sum_{\tau=1}^{t}\epsilon^{t-\tau}\sum_{m=1}^{M}\xi_\tau(m)\frac{(y_T-\mu_m^y)}{\Sigma_m^y}(1-G_m) - \frac{\rho(n_t-\mu_n)}{\Sigma^n} = 0. \quad \text{EQ. 27}$$

Substituting equation 25 into equation 27 and solving for $n_t$, the MAP estimate of noise is represented by:

$$\hat{n}_t = \frac{s_t + \rho\mu_n/\Sigma^n + K_t n_0}{K_t + \rho/\Sigma^n}, \quad \text{EQ. 28}$$

where $$s_t = \sum_{\tau=1}^{t}\epsilon^{t-\tau}\sum_{m=1}^{M}\xi_\tau(m)(y_\tau-\mu_m^x-g_m)\frac{(1-G_m)}{\Sigma_m^y},$$

and $$K_t = \sum_{\tau=1}^{t}\epsilon^{t-\tau}\sum_{m=1}^{M}\xi_\tau(m)\frac{(1-G_m)^2}{\Sigma_m^y}.$$

The $s_t$ and $K_t$ above can be efficiently computed by making use of the previous computation for $s_{t-1}$ and $K_{t-1}$ via recursion as discussed above for the recursive ML noise estimation. In one embodiment, an efficient recursive computation for $K_t$ can be represented as:

$$K_t = \epsilon K_{t-1} + \sum_{m=1}^{M} \xi_t(m) \frac{(1 - G_m)^2}{\Sigma_m^y}.$$

Figure 5:
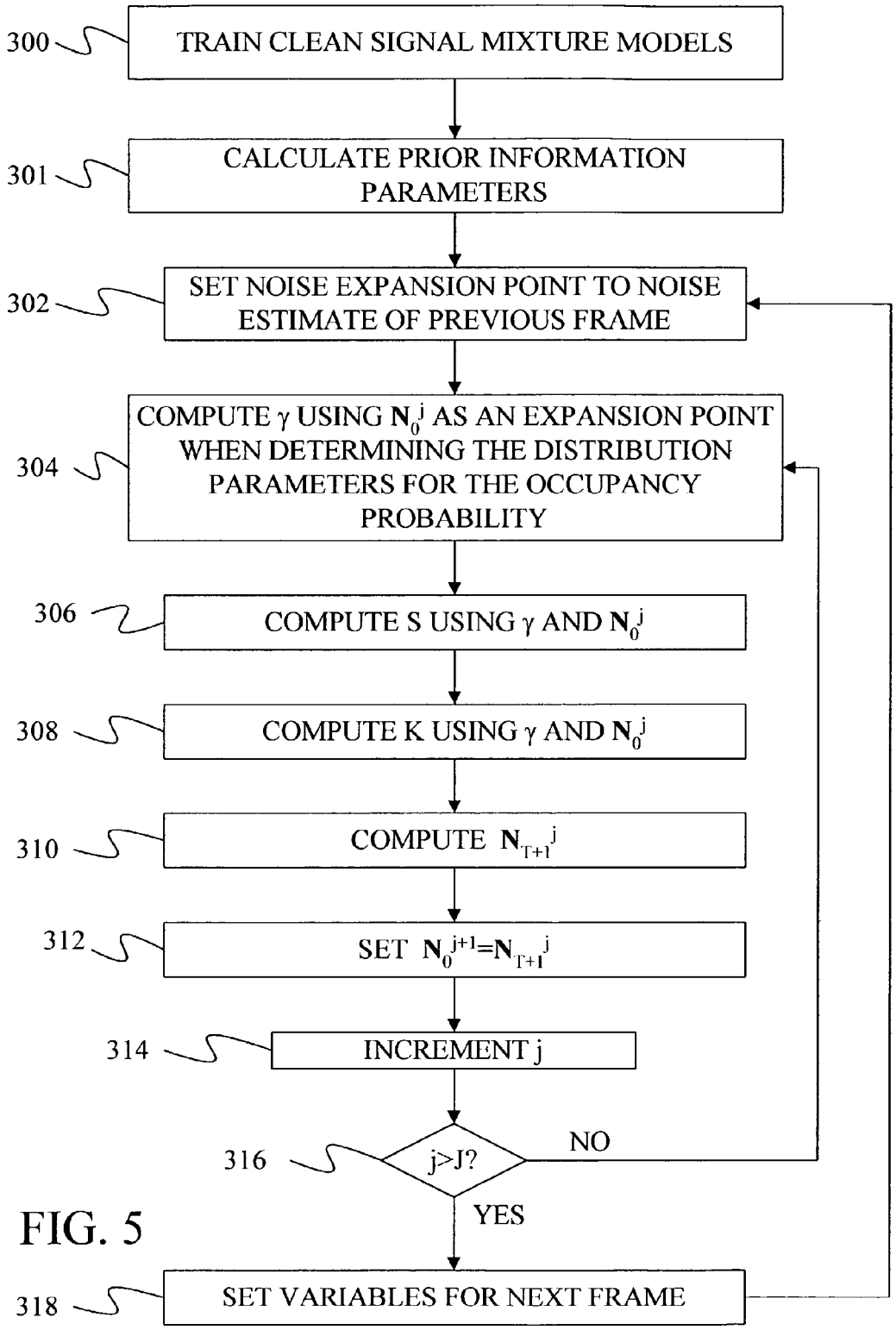
FIG. 5 is a flow diagram of a method of estimating noise under another embodiment of the present invention.

In general, the iterations illustrated in FIG. 3 are also followed in the MAP estimate of noise as illustrated in FIG. 5. However, an additional step 301 prior to step 302 includes calculation of the prior information for each utterance, wherein steps 302, 304, 306, 308, 310, 312, 314, 316 and 318 are performed for each utterance. (Note $\xi$ is equivalent to $\gamma$.) Initially, $n_0$ can be set equal to the mean, $\mu_n$, of the prior information.

It should be noted that the MAP estimate of Eq. 27 reverts to the ML noise estimate discussed above, when $\rho$ is set to zero or when the variance of the noise prior distribution goes to infinity. In either of these extreme cases, the prior distribution of the noise would be expected to provide no information as far as noise estimation is concerned.

It should also be noted that the MAP estimate of noise $n_t$ is approximately equal to $\mu_n$ if the variance for the prior information is low. With respect to FIG. 4, this means that portions 352 and 354 are nearly identical, therefore, the noise estimate for the observation portion 356 should be substantially similar to the mean $\mu_n$ of the prior information. (In this situation, the terms $\rho\mu_n/\Sigma_n$ and $\rho/\Sigma_n$ dominate with $\rho$ and $\Sigma_n$ canceling out.)

The noise estimation techniques described above may be used in a noise normalization technique or noise removal such as discussed in a patent application entitled METHOD OF NOISE REDUCTION USING CORRECTION VECTORS BASED ON DYNAMIC ASPECTS OF SPEECH AND NOISE NORMALIZATION, application Ser. No. 10/117,142, filed Apr. 5, 2002. The invention may also be used more directly as part of a noise reduction system in which the estimated noise identified for each frame is removed from the noisy signal to produce a clean signal such as described in patent application entitled NON-LINEAR OBSERVATION MODEL FOR REMOVING NOISE FROM CORRUPTED SIGNALS, application Ser. No. 10/237,163, filed on even date herewith.

Figure 6:
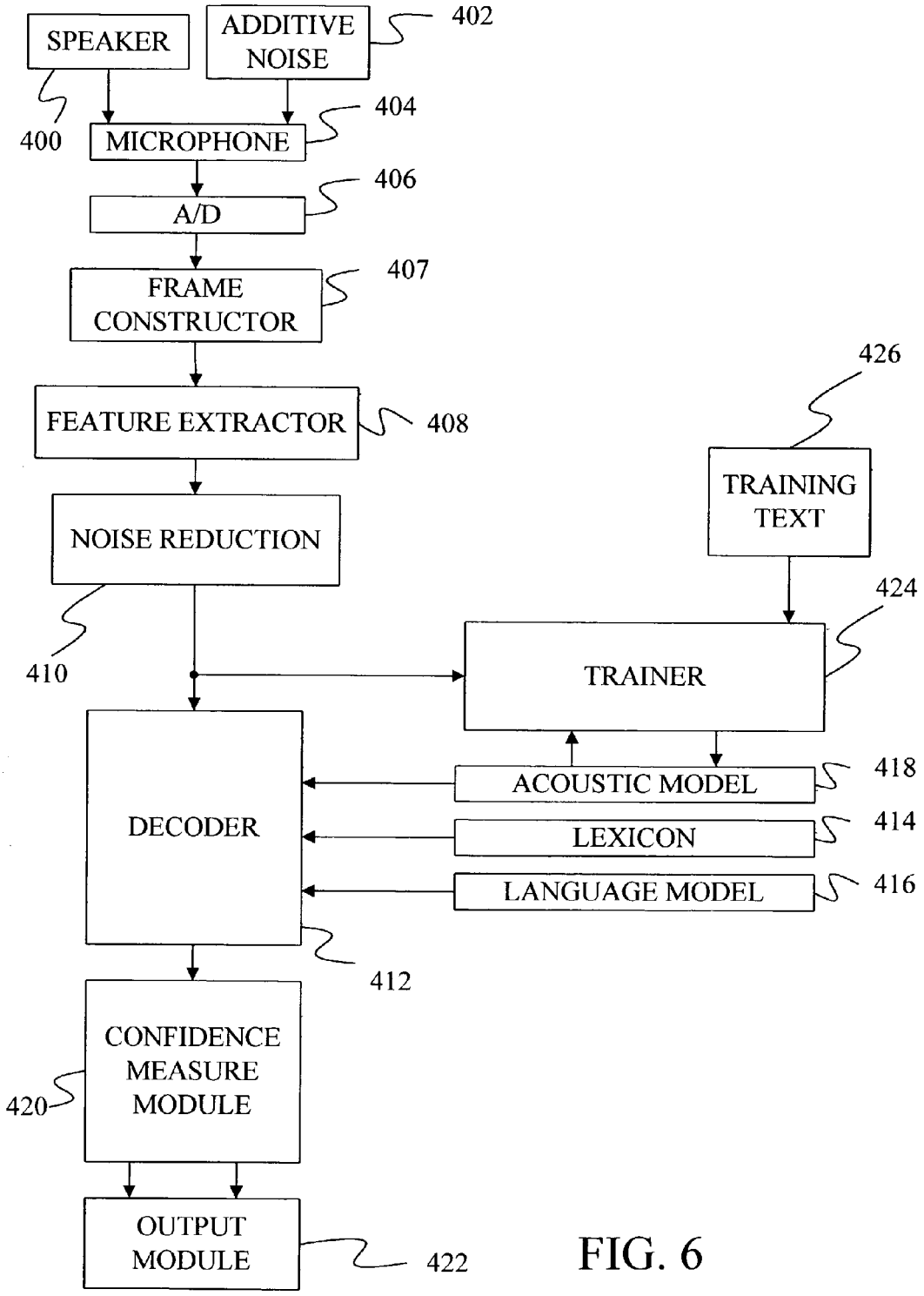
FIG. 6 is a block diagram of a pattern recognition system in which the present invention may be used.

FIG. 6 provides a block diagram of an environment in which the noise estimation technique of the present invention may be utilized to perform noise reduction. In particular, FIG. 6 shows a speech recognition system in which the noise estimation technique of the present invention can be used to reduce noise in a training signal used to train an acoustic model and/or to reduce noise in a test signal that is applied against an acoustic model to identify the linguistic content of the test signal.

In FIG. 6, a speaker 400, either a trainer or a user, speaks into a microphone 404. Microphone 404 also receives additive noise from one or more noise sources 402. The audio signals detected by microphone 404 are converted into electrical signals that are provided to analog-to-digital converter 406.

Although additive noise 402 is shown entering through microphone 404 in the embodiment of FIG. 6, in other embodiments, additive noise 402 may be added to the input speech signal as a digital signal after A-to-D converter 406.

A-to-D converter 406 converts the analog signal from microphone 404 into a series of digital values. In several embodiments, A-to-D converter 406 samples the analog signal at 16 kHz and 16 bits per sample, thereby creating 32 kilobytes of speech data per second. These digital values are provided to a frame constructor 407, which, in one embodiment, groups the values into 25 millisecond frames that start 10 milliseconds apart.

The frames of data created by frame constructor 407 are provided to feature extractor 408, which extracts a feature from each frame. Examples of feature extraction modules include modules for performing Linear Predictive Coding (LPC), LPC derived cepstrum, Perceptive Linear Prediction (PLP), Auditory model feature extraction, and Mel-Frequency Cepstrum Coefficients (MFCC) feature extraction. Note that the invention is not limited to these feature extraction modules and that other modules may be used within the context of the present invention.

The feature extraction module produces a stream of feature vectors that are each associated with a frame of the speech signal. This stream of feature vectors is provided to noise reduction module 410, which uses the noise estimation technique of the present invention to estimate the noise in each frame.

The output of noise reduction module 410 is a series of "clean" feature vectors. If the input signal is a training signal, this series of "clean" feature vectors is provided to a trainer 424, which uses the "clean" feature vectors and a training text 426 to train an acoustic model 418. Techniques for training such models are known in the art and a description of them is not required for an understanding of the present invention.

If the input signal is a test signal, the "clean" feature vectors are provided to a decoder 412, which identifies a most likely sequence of words based on the stream of feature vectors, a lexicon 414, a language model 416, and the acoustic model 418. The particular method used for decoding is not important to the present invention and any of several known methods for decodeing may be used.

The most probable sequence of hypothesis words is provided to a confidence measure module 420. Confidence measure module 420 identifies which words are most likely to have been improperly identified by the speech recognizer, based in part on a secondary acoustic model (not shown). Confidence measure module 420 then provides the sequence of hypothesis words to an output module 422 along with identifiers indicating which words may have been impoperly identified. Those skilled in the art will recognize that confidence measure module 420 is not necessary for the practice of the present invention.

Although FIG. 6 depicts a speech recognition system, the present invention may be used in any pattern recognition system and is not limited to speech.

Although the present invention has been described with reference to particular embodiments, workers skilled in the art will recognize that changes may be made in form and detail without departing from the spirit and scope of the invention.

What is claimed is:

1. A method for estimating noise in a noisy signal, the method comprising:

dividing the noisy signal into frames;

determining a noise estimate for a first frame of the noisy signal;

determining a noise estimate for a second frame of the noisy signal based in part on the noise estimate for the first frame; and using the noise estimate for the second frame and the noise estimate for the first frame to determine a second noise estimate for the second frame as a function of a maximum likelihood criteria.

2. The method of claim 1 wherein using the noise estimate for the second frame and the noise estimate for the first frame comprises using the noise estimate for the second frame and the noise estimate for the first frame in an update equation that is the solution to a recursive Expectation-Maximization optimization problem.

3. The method of claim 2 wherein the update equation is based in part on a definition of the noisy signal as a non-linear function of a clean signal and a noise signal.

4. The method of claim 2 wherein each noise estimate is a function of a maximum a posterior criteria.

5. The method of claim 3 wherein the update equation is further based on an approximation to the non-linear function.

6. The method of claim 5 wherein the approximation equals the non-linear function at a point defined in part by the noise estimate for the second frame.

7. The method of claim 6 wherein the approximation is a Taylor series expansion.

8. The method of claim 1 wherein using the noise estimate for the second frame comprises using the noise estimate for the second frame as an expansion point for a Taylor series expansion of a non-linear function.

9. A computer-readable medium having computer-executable instructions for performing steps comprising:

dividing a noisy signal into frames;

iteratively estimating the noise in each frame such that in at least one iteration for a current frame the estimated noise is based on a noise estimate for at least one other frame and a noise estimate for the current frame produced in a previous iteration; and using the noise estimate to reduce noise in the noisy signal.

10. The computer-readable medium of claim 9 wherein iteratively estimating the noise in a frame comprises using the noise estimate for the current frame produced in a previous iteration to evaluate at least one function.

11. The computer-readable medium of claim 10 wherein the at least one function is based on an assumption that a noisy signal has a non-linear relationship to a clean signal and a noise signal.

12. The computer-readable medium of claim 11 wherein the function is based on an approximation to the non-linear relationship between the noisy signal the clean signal and the noise signal.

13. The computer-readable medium of claim 12 wherein the approximation is a Taylor series approximation.

14. The computer-readable medium of claim 13 wherein the noise estimate for the current frame produced in a previous iteration is used to select an expansion point for the Taylor series expansion.

15. The computer-readable medium of claim 9 wherein iteratively estimating the noise in each frame comprises estimating the noise using an update equation that is based on a recursive Expectation-Maximization calculation.

16. The computer-readable medium of claim 15 wherein the recursive Expectation-Maximization calculation is a function of a maximum likelihood criteria.

17. The computer-readable medium of claim 15 wherein the recursive Expectation-Maximization calculation is a function of a maximum a posterior criteria.

18. The computer-readable medium of claim 17 wherein the maximum a posterior criteria includes prior information being a function only of noise.

19. The computer-readable medium of claim 18 and further comprising instructions for calculating a noise estimate of the prior information.

20. The computer readable medium of claim 19 wherein the noise estimate of the prior information is used initially in iteratively estimating the noise.

21. The computer readable medium of claim 9 and further comprising using the noise estimate to normalized noise.

22. A method of estimating noise in a current frame of a noisy signal, the method comprising:

applying a previous estimate of the noise in the current frame to at least one function to generate an update value; and adding the update value to an estimate of noise in a second frame of the noisy signal to produce an estimate of the noise in the current frame, wherein each estimate of noise is a function of a maximum likelihood criteria.

23. The method of claim 22 wherein applying a previous estimate of the noise in the current frame comprise applying the previous estimate to a function that is based on an approximation to a non-linear function.

24. The method of claim 23 wherein the approximation is a Taylor series approximation.

25. The method of claim 24 wherein applying the previous estimate of the noise comprises using the previous estimate of the noise to define an expansion point for the Taylor series approximation.

26. The method of claim 23 wherein applying a previous estimate of the noise in the current frame to at least one function comprises applying the previous estimate to define distribution values for a distribution of noisy feature vectors in terms of distribution values for clean feature vectors.

27. The method of claim 26 wherein each estimate of noise is a function of a maximum a posterior criteria.

* * * * *